US011678425B2

(12) United States Patent
Lee et al.

(10) Patent No.: US 11,678,425 B2
(45) Date of Patent: Jun. 13, 2023

(54) DIMMERS HAVING CAPABILITIES TO ADJUST END TRIM VALUES

(71) Applicant: EATON INTELLIGENT POWER LIMITED, Dublin (IE)

(72) Inventors: Hoon Lee, Sugar Hill, GA (US); Gayatri Pandit, Pune (IN); Swapnil Suresh Sabde, Pune (IN); Rahul Sakhare, Pune (IN); Saivaraprasad Murahari, Peachtree City, GA (US); Haidong Harry Zhang, Shanghai (CN); Shifang Sophia Sophia Zhang, Shanghai (CN); Lili Lily Du, Shanghai (CN); Kun Kevin Zhong, Shanghai (CN)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 17/717,338

(22) Filed: Apr. 11, 2022

(65) Prior Publication Data

US 2022/0338329 A1 Oct. 20, 2022

Related U.S. Application Data

(60) Provisional application No. 63/174,702, filed on Apr. 14, 2021.

(51) Int. Cl.

| | |
|---|---|
| ***H05B 47/10*** | (2020.01) |
| ***H05B 47/17*** | (2020.01) |
| ***H05B 45/10*** | (2020.01) |
| ***H05B 45/30*** | (2020.01) |
| ***H01H 3/02*** | (2006.01) |
| ***H05B 47/14*** | (2020.01) |

(52) U.S. Cl.
CPC ..... *H05B 47/17* (2020.01); *H01H 3/0213* (2013.01); *H05B 47/14* (2020.01)

(58) Field of Classification Search
None
See application file for complete search history.

(56) References Cited

U.S. PATENT DOCUMENTS

| | | | | |
|---|---|---|---|---|
| 8,492,996 | B2 * | 7/2013 | Gehman | H05B 39/085 307/140 |
| 8,963,440 | B2 * | 2/2015 | Jennings | H05B 47/10 315/307 |
| 9,996,096 | B2 * | 6/2018 | Testani | H01H 23/168 |

* cited by examiner

*Primary Examiner* — Dedei K Hammond
(74) *Attorney, Agent, or Firm* — Eckert Seamans Cherin & Mellott, LLC

(57) ABSTRACT

A dimmer includes a sole intensity actuator structured to be used for at least one of: adjusting light intensity based on a first user input during normal operation; or entering configuration mode based on a second user input and adjusting an end trim value based on a third user input; a sole intensity potentiometer coupled to the sole intensity actuator and comprising a variable resistor, the sole intensity potentiometer structured to measure an input voltage based on variable resistance, and a controller coupled to the sole intensity potentiometer and a driver circuit coupled to a bidirectional switching device, the controller structured to control dimmer operation, comprising receiving an input voltage signal and transmitting a dimming signal to the driver circuit, the dimming signal based at least in part on the signal.

23 Claims, 9 Drawing Sheets

DIMMERS HAVING CAPABILITIES TO ADJUST END TRIM VALUES

CROSS-REFERENCE TO RELATED APPLICATION

This patent application claims the priority benefit under 35 U.S.C. § 119(e) of U.S. Provisional Application No. 63/174,702, filed on Apr. 14, 2021, the contents of which are herein incorporated by reference.

BACKGROUND OF THE INVENTION

Field of the Invention

The disclosed concept relates generally to dimmers for use with a load, and in particular, to dimmers having capabilities to adjust end trim values. The disclosed concept also relates to dimmer systems.

Background Information

Dimmers provide a dimming function for loads such as lights. Dimmers are generally placed between a power source and the load and control the nature of the power provided to the load. Very simple dimmers regulate the voltage provided to the load by, for example, dividing the voltage using a variable resistor. More recent dimmers cut off a part of each half-cycle of the power provided to the load. In some dimmers, the cut off is from a zero crossing in the power until a predetermined time after the zero crossing. Increasing the predetermined amount of time increases the amount of dimming. Cutting off a part of the waveform can be accomplished using a circuit component such as a TRIAC (triode for alternating current). The dimmers typically use a potentiometer coupled to an intensity actuator (e.g., a main slider of the dimmers) for adjusting intensity of light. Some two-wire dimmers use an additional potentiometer for adjusting a low-end trimming values (i.e., low-end or minimum light intensity levels). The additional potentiometer, however, requires additional space for installation and a controller to continuously monitor the analog to digital converter voltage for sensing a trim level as well as a slider input for, e.g., course control. Further, the two-wire dimmers do not have a capability for adjusting high-end trim levels (i.e., high-end or maximum light intensity levels) of the dimmers.

There is room for improvement in dimmers.

SUMMARY OF THE INVENTION

These needs, and others, are met by at least one embodiment of the disclosed concept in which a dimmer includes a sole intensity actuator structured to be actuated between a maximum light intensity and a minimum light intensity by a user, and is further structured to be used for at least one of: adjusting light intensity based on a first user input during normal operation; or entering configuration mode based on a second user input; and adjusting an end trim value based on a third user input; a sole intensity potentiometer mechanically coupled to the sole intensity actuator and comprising a variable resistor, the sole intensity potentiometer structured to measure an input voltage based on variable resistance, wherein the variable resistance changes based on a position of the sole intensity actuator corresponsive to the first user input, the second user input, or the third user input; and a controller coupled to the sole intensity potentiometer and a driver circuit coupled to a bidirectional switching device, the controller structured to control dimmer operation, comprising receiving a signal indicative of the measured input voltage from the sole intensity potentiometer and transmitting a dimming signal to the driver circuit for driving the bidirectional switching device, the dimming signal based at least in part on the signal.

In accordance with an example embodiment of the disclosed concept, a dimmer system including a load, a hot conductor electrically coupled to a power source, a load conductor electrically coupled to the load; and a dimmer electrically coupled to the hot conductor and the load conductor. The dimmer includes: a sole intensity actuator structured to be actuated between a maximum light intensity and a minimum light intensity by a user, and is further structured to be used for at least one of: adjusting light intensity based on a first user input during normal operation; or entering configuration mode based on a second user input; and adjusting an end trim value based on a third user input; a sole intensity potentiometer mechanically coupled to the sole intensity actuator and comprising a variable resistor, the sole intensity potentiometer structured to measure an input voltage based on variable resistance, wherein the variable resistance changes based on a position of the sole intensity actuator corresponsive to the first user input, the second user input, or the third user input; and a controller coupled to the sole intensity potentiometer and a driver circuit coupled to a bidirectional switching device, the controller structured to control dimmer operation, comprising receiving a signal indicative of the measured input voltage from the sole intensity potentiometer and transmitting a dimming signal to the driver circuit for driving the bidirectional switching device, the dimming signal based at least in part on the signal.

In accordance with an example embodiment of the disclosed concept, a method for adjusting an end trim value includes: determining whether a user input requesting for configuration mode is detected, the user input including a first actuation of a sole intensity actuator coupled to a sole intensity potentiometer within the dimmer; based on a determination that the user input is detected, entering the configuration mode, adjusting the end trim value based on another user input comprising a second actuation of the sole intensity actuator coupled to the sole intensity potentiometer, exiting the configuration mode; and operating the dimmer based at least in part on the new end trim value in a normal operation mode; or based on a determination that the user input requesting for the configuration mode is not detected, operating the dimmer in the normal operation mode based on maximum light intensity, minimum light intensity, or a previously determined end trim value.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
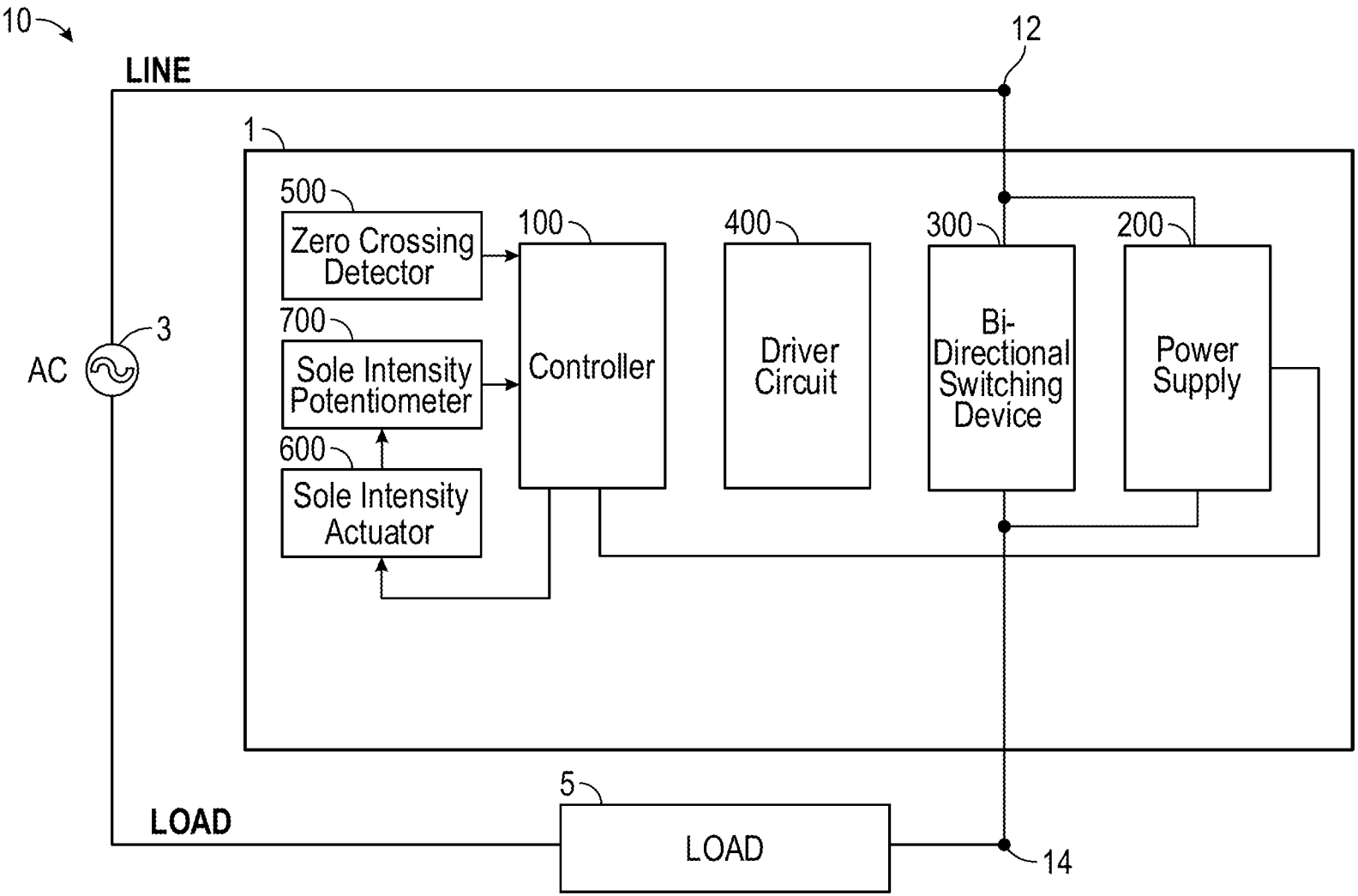
FIG. 1 is a schematic diagram of a dimmer system including a two-wire dimmer in accordance with an example embodiment of the disclosed concept.

Directional phrases used herein, such as, for example, clockwise, counterclockwise, left, right, top, bottom, upwards, downwards and derivatives thereof, relate to the orientation of the elements shown in the drawings and are not limiting upon the claims unless expressly recited therein.

As used herein, the singular form of "a," "an," and "the" include plural references unless the context clearly dictates otherwise.

As used herein, the term "number" shall mean one or an integer greater than one (i.e., a plurality).

Conventional dimmers require a secondary potentiometer coupled to a secondary intensity actuator to achieve end-trimming functionality. The additional secondary potentiometer, however, requires additional space for installation and a controller to continuously monitor the analog to digital converter (ADC) input for sensing a trim level as well as an intensity actuator input (e.g., a main slider input). Further, the two-wire dimmers do not have a capability for adjusting high-end trim level (i.e., high-end or maximum light intensity levels) of the dimmers, thereby restricting the end trimming only to low-end trimming. In addition, adding the secondary potentiometer in the dimmers increases manufacturing cost and energy consumption by requiring the controller to continuously monitor the ADC input. In addition, the requirement for the secondary intensity actuator leads to complications in installation, customization and/or assembly of the dimmers on, e.g., the wall-box since the secondary intensity actuator added externally to the dimmers should fit within the wall box, which is already crowded with the dimmers alone. Moreover, conventional two-wire dimmers do not save the new low-end trim value selected by the user, and thus, the controller needs to constantly monitor the ADC input.

Example embodiments of the disclosed concept address these issues. For example, the dimmers allow the users to enter into configuration mode and adjust end trim values using a sole intensity actuator (e.g., the main slider of the dimmer) coupled to a sole intensity potentiometer without requiring an additional intensity actuator coupled to an additional intensity potentiometer. Thus, the user may simply actuate the intensity actuator that is available externally on the dimmer to enter the configuration mode and adjust an end trim value. Further, the dimmer includes a capability to adjust a high-end trim value by using the same sole intensity actuator coupled to the sole intensity actuator. Additionally, since the dimmer does not require an additional sole intensity potentiometer for adjusting light intensity and/or end trim values, the controller need not continuously monitor its ADC pin for input voltage indicative of the trim values or main actuator input, thereby reducing the energy consumption and freeing up the controller to perform its other functionalities.

FIG. 1 is a schematic diagram of a dimmer system 10 including a two-wire dimmer 1 in accordance with an example embodiment of the disclosed concept. The dimmer system 10 includes a LINE conductor 12 and a LOAD conductor 14. A two-wire dimmer 10 is coupled in series between an alternating-current (AC) power source 3 and the load 5. The AC power source 3 may be 120 Vac residential power or another suitable power source. The load 5 may be a lighting device (e.g., an incandescent lamp, a fluorescent light, LED, etc.). The two-wire dimmer 1 is structured to be mounted to a standard electrical wall-box and the LINE conductor 12 is coupled to the hot side of the AC power source 3 and a dimmed hot terminal 14 is coupled to the load 5. As such, the LINE conductor 12 may be also referred to as a HOT conductor, and the dimmed hot terminal 14 may be also referred to as a LOAD conductor. Two-wire dimmers do not require a connection to a NEUTRAL conductor. The dimmer 1 is structured to control dimming of the load 5 by controlling the nature of the power provided to the LOAD conductor 14. For example, in some example embodiments, the dimmer 1 is structured to cut off a part of the waveform provided to the LOAD conductor 14 each half-cycle. The power provided to the LOAD conductor 14 powers the load 5.

Figure 2:
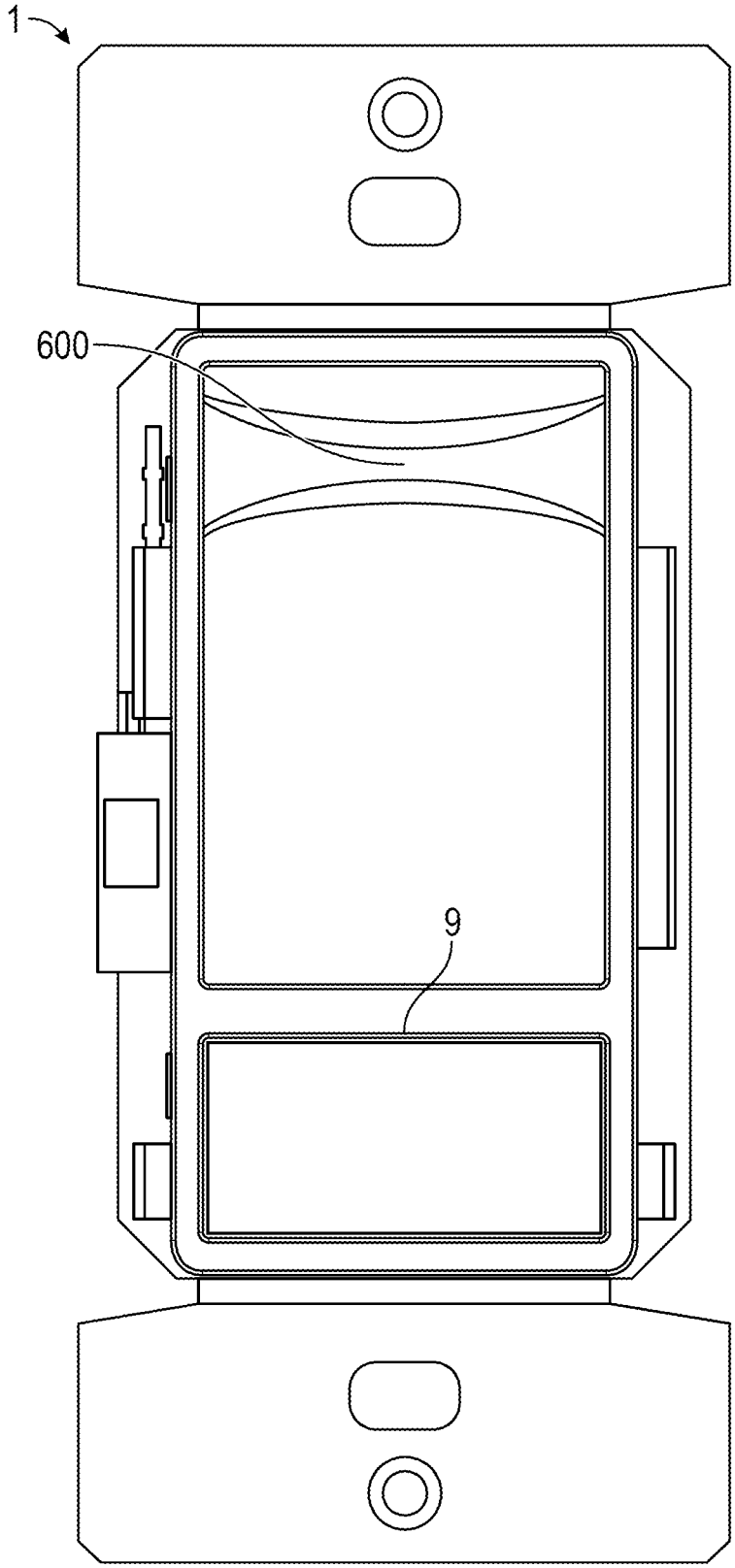
FIG. 2 is a diagram of a dimmer in accordance with an example embodiment of the disclosed concept.

The dimmer 1 includes a controller 100, a power supply 200, a bidirectional switching device 300, a driver circuit 400, a zero crossing detector (ZCD) 500, a sole intensity actuator 600, and a sole intensity potentiometer 700. The dimmer 1 may also include an external toggle button or rocker switch (a switch 9 as shown in FIG. 2) for turning the load 5 on or off by the user. The controller 100 is coupled to the sole intensity potentiometer 700 and a driver circuit 400 coupled to a bidirectional switching device 300, the controller 100 structured to control dimmer operation, including receiving a signal indicative of the measured input voltage from the sole intensity potentiometer and transmitting a dimming signal to the driver circuit 400 for driving the bidirectional switching device 300, the dimming signal based at least in part on the signal The controller 100 is further structured to store a new end trim value in a memory such that the controller 100 controls the dimmer operation without continuously monitoring an analog to digital converter pin for sensing the first user input, the second user input, or the third user input. The controller 100 is also coupled to the power supply 200 for receiving DC power, the ZCD 500 for providing a signal indicating time when the bidirectional switching device may be rendered conductive or nonconductive. The controller 100 is structured to control the operation of the dimmer 1. For example, the controller 100 may provide one or more control signals to control various functionalities (e.g., high-end and/or low-end trimming, entering configuration mode, exiting configuration mode, operating during normal mode, etc.) of the dimmer 1. The controller 100 may include a processor and a memory. The processor may be, for example and without limitation, a microprocessor, a microcontroller, or some other suitable processing device or circuitry, that interfaces with the memory. The memory can be any of one or more of a variety of types of internal and/or external storage media such as, without limitation, RAM, ROM, EPROM(s), EEPROM(s), FLASH, and the like that provide a storage register, i.e., a machine readable medium, for data storage such as in the fashion of an internal storage area of a computer, and can be volatile memory or nonvolatile memory.

The power supply 200 receives electrical energy from the AC power source 3 and supplies DC power to the controller 100 and other DC components within the dimmer 1. Upon powering on of the dimmer 1, the power supply 200 provides input voltage (e.g., 3.3V, 5V, etc.) to the controller 100, which in turn transmits a dimming signal to the driver circuit 400 based on the ADC input received from the sole intensity potentiometer 700. As such, upon power on, the power supply 200 receives AC voltage (e.g., 110V, 120V, 270V, etc.) from the AC power source 3, converts the AC voltage to DC voltage via a rectifier, performs voltage division so as to provide low voltage sufficient to power the control circuit 100 and other DC components within the dimmer 1.

The bidirectional switching device 300 may be a semiconductor switch, e.g., a thyristor (e.g., a triode for AC (TRIAC), Field-Effect Transistors (FETs), etc. The bidirectional switching device 300 is connected in series with the AC power source 3 and the load 5, and structured to control the amount of power delivered to the load 5 based at least in part on a signal received from a driver circuit 400, which is coupled to the bidirectional switching device 300 and structured to drive the bidirectional switching device 300. The bidirectional switching device 300 is structured to receive gate voltage signals from the driver circuit 400 for becoming conductive or non-conductive. The bidirectional switching device 300 is structured to control the amount of power delivered to the load 5, by becoming conductive or non-conductive for parts of a half-cycle of the AC power source 3 based on the signal received from the driver circuit 400. The bidirectional switching device 300 may use a forward phase-control or reverse phase-control in order to control when the bidirectional switching device 300 controls the power delivered to the lighting load 5.

The driver circuit 400 is coupled to the controller 100 and the bidirectional switching device 300. The driver circuit 400 drives the bidirectional switching device 300 by providing a signal (e.g., a gate drive signal) to the gate of the bidirectional switching device 300. The driver circuit 400 may be a TRIAC control circuit and is structured to receive waveforms, e.g., dimming signals, from the controller 100, and control the operation of the TRIAC and any other components of the driver circuit 400. A dimming signal may include a ZCD signal which indicates timing of when the AC is crossing zero. The driver circuit 400 may render the bidirectional switching device 300 conductive or non-conductive based at least in part on the ZCD signal. The driver circuit 400 may provide a constant gate voltage signal to the bidirectional switching device 300 so that the bidirectional switching device 300 is constantly supplied with power.

Zero crossing detector (ZCD) 500 is structured to detect current crossing at near zero as the sine signal repeatedly goes up to its peak current and down to zero current. Upon detecting such crossing, the ZCD 500 transmits a signal to the controller 100, which in turn activates the driver circuit 400 and transmit the ZCD signal to the driver circuit 400 for controlling the bidirectional switching device 300. ZCD 500 may be used for protecting electronic devices from a power surge upon switching on of the devices. For example, when an electronic device is switched on, the device may be subjected to a sudden entry of the AC and if this entry point occurs at the peak of the AC sinusoidal signal, the device may experience maximum current supplied at the switching on, thereby damaging the electronic device. As such, ZCD ensures that during power on of the devices, the AC mains would be entering its first zero crossing point, thereby protecting the electronic devices such as the load 5 from a power surge at power on and preventing damage to the load 5 due to the power surge. Further, the driver circuit 400 controls the bidirectional switching device 300 based at least in part of the ZCD signal as to determining when the bidirectional switching device 300 should be conductive or non-conductive.

Sole intensity actuator 600 is operable by the user and coupled to the power supply 200 and the sole intensity potentiometer 700. The sole intensity actuator 600 and the sole intensity potentiometer 700 are mechanically coupled to each other, and thus, when the user actuates the sole intensity actuator 600 (e.g., by moving, sliding, pressing, pushing, etc.), both the sole intensity actuator 600 and the sole intensity potentiometer 700 move in unison. The sole intensity actuator 600 coupled to the potentiometer 700 is structured to control the amount of power delivered to the load 5 between the minimum amount of power and the maximum amount of power in normal operation mode. The sole intensity actuator 600 (e.g., a slider) coupled to the potentiometer 700 is used for the dimmer 1 to operate in both the configuration mode and normal operation mode. The sole intensity actuator 600 is structured to control the maximum and/or minimum intensity in the configuration mode. In normal operation mode, the sole intensity actuator 600 is structured to dim the light between the maximum and minimum intensity level set during configuration mode. Upon exiting the configuration mode, the controller 100 stores the value of new trim value.

The sole intensity actuator 600 may perform low-end trimming and/or high-end trimming. High-end or low-end trimming means the adjustment of maximum and/or minimum intensity of the light, which is controlled by the maximum and minimum amount of power delivered by the dimmer 1 connected to the load 5. The maximum (e.g., 100% light intensity) and/or minimum (e.g., 0% light intensity) intensity of light may be set by the manufacturer, and may also be referred to as the default maximum and/or default minimum light intensity, respectively, herein. The low-end intensity value may be trimmed between the default minimum light intensity value and a previously determined low-end trim value. The high-end intensity value may be trimmed from the default maximum light intensity value and a previously determined high-end trim value. The previously determined end trim values may include predetermined low-end trim value (typically 35% light intensity) and/or high-end trim value (typically 40% light intensity) set by the manufacturer or previously configured low-end and/or high-end trim values configured by the user. The previously configured end trim values by the user may be any end trim values between 0 and 100% light intensity level. The default minimum light intensity value, default maximum light intensity value, and predetermined low-end and/or high-end trim values are provided to the user upon, e.g., purchase of the dimmer 1.

During the normal operation mode, the user simply inputs the light intensity level s/he desires based on the default maximum and minimum light intensity values by moving the sole intensity actuator 600 to the desired light intensity level upon turning on of the dimmer 1. To enter the configuration mode, the user actuates the sole intensity actuator 600 in a predetermined manner (e.g., actuating the sole intensity actuator 600 between maximum and minimum light intensity level a predetermined number of times within a predetermined period of time). During the configuration mode, the user may adjust the low-end trim value and/or high-end trim value using the sole intensity actuator 600.

In an example embodiment, the sole intensity actuator 600 is structured to be actuated between a maximum light intensity and a minimum light intensity by a user, and is further structured to be used for at least one of: adjusting light intensity based on a first user input during normal operation; or entering configuration mode based on a second user input; and adjusting an end trim value based on a third user input The first user input includes actuating the sole intensity actuator based on the maximum light intensity, the minimum light intensity, or a predetermined end trim value.

In general, for low-end trimming, the second user input includes actuating the sole intensity actuator 600 from below a first predetermined level to above a second predetermined level and back a predetermined number of times within a first predefined time, and the third user input comprises actuating the sole intensity actuator 600 to a position indicative of a new low-end trim value selected by the user. Entering the configuration mode comprises a first visual indication comprising changing the light intensity of the load in a first sequence including ramping down the load to the minimum light intensity, ramping up the load to the maximum light intensity, and ramping down the load to the minimum light intensity. Adjusting the low-end trim value includes storing the new low-end trim value in a memory, exiting the configuration mode, and operating based at least in part on the new low-end trim value in the normal operation mode. Exiting the configuration mode includes a second visual indication comprising changing the light intensity of the load in a second sequence including ramping down the load to the minimum light intensity, ramping up the load to the maximum light intensity, and ramping down the load to the minimum light intensity; and ramping up the load to the new low-end trim value selected by the user. More detail with respect to the low-end trimming is provided below.

In general, for high-end trimming, the second input includes actuating the sole intensity actuator 600 from above a third predetermined level to below a fourth predetermined level and back a predetermined number of times (e.g., without limiting three times) within a first predefined time (e.g., without limiting five seconds), and the third input includes moving the sole intensity actuator to a position indicative of a new high-end trim value selected by the user. Entering the configuration mode includes a third visual indication comprising changing the light intensity of the load in a third sequence including ramping down the load to the minimum light intensity, and ramping up the load to the maximum light intensity. Adjusting the high-end trim value includes storing the new high-end trim value in memory, exiting the configuration mode, and operating based at least in part on the new high-end trim value in the normal operation mode. Exiting the configuration mode includes a fourth visual indication including changing the light intensity of the load in a fourth sequence including ramping up the load to the maximum light intensity, ramping down the load to the minimum light intensity, ramping up the load to the maximum light intensity, and ramping down the load to the new high-end trim value selected by the user. More detail with respect to the high-end trimming is provided below.

In an example embodiment, to enter a configuration mode for adjusting low-end trim value, the user first turns on the dimmer 1. Upon turning on or before turning on the dimmer 1, the user may move the sole intensity actuator 600 to a first position below or equal to a first predetermined level (e.g., without limitation, below 40% of the maximum level, equal to 0% of the maximum level, etc.), then, the user may move the sole intensity actuator 600 to a second position above or equal to a second predetermined level (e.g., without limitation, above 60% of the maximum level, equal to 100% of the maximum level, etc.) and back to below the first predetermined level a predetermined number of times (e.g., without limitation, three times) within a first predefined period (e.g., without limitation, five seconds). Upon completion of moving the sole intensity actuator 600 the predetermined number of times within the first predefined period, the controller 100 causes the dimmer 1 to enter into the configuration mode to adjust the low-end trim value and the user releases the sole intensity actuator 600. In some cases, in order to indicate that the dimmer 1 has entered into the configuration mode for adjusting the low-end trim value, the controller 100 may cause the load 5 to be ramped down to the default minimum light intensity value, ramped up to the maximum light intensity value, and then ramped down back to the default minimum light intensity value. In some cases, such indication may include the load 5 being ramped up to the default maximum light intensity value, and then down to the default minimum light intensity value. This sequence is for illustrative purposes only and may change according to the user preference, needs, etc. In some cases, during such indication of the dimmer entering the configuration mode, the user may wait and not adjust the light intensity level. Subsequently, the user selects a new low-end trim value by actuating the sole intensity actuator 600 between 0% and 100% light intensity positions. The new low-end trim value may be between the default minimum intensity value and the predetermined low-end trim value (typically 35% light intensity level) or any low-end light intensity value as desired by the user. Next, the new low-end trim value is saved in the memory if the sole intensity actuator 600 has stopped moving for a second predefined period (e.g., five seconds) as the user has moved the sole intensity actuator to the desired new low-end trim value. The first and second predefined period may be the same or different. In order to indicate that the dimmer 1 has exited the configuration mode, the load 5 may be ramped down to the default minimum intensity level (0%) and then up to the default maximum intensity level (100%), and then to the new low-end trim value. In some cases, exiting the configuration mode may be indicated by the load 5 being ramped up to the default maximum intensity level and back down to the new low-end trim value. These sequences are for illustrative purposes only, and thus may change at the user's preference or needs. In some cases, during such indication of the dimmer 1 exiting the configuration mode, the user may wait and not control the light intensity by moving the sole intensity actuator 600.

In an example embodiment, to enter a configuration mode for adjusting high-end trim value, the user first turns on the dimmer 1. Upon turning on or before turning on the dimmer 1, the user may actuate the sole intensity actuator 600 from a third position above or equal to a third predetermined level (e.g., without limitation, above 60% of the maximum level, equal to 100% of the maximum level, etc.) to a fourth position below or equal to a fourth predetermined level (e.g., without limitation, below 40% of the maximum level, equal to 0% of the maximum level, etc.) and back a predetermined number (e.g., three times, four times, etc.) of times within a first predefined time (e.g., five seconds, etc.). Upon completion of actuating the sole intensity actuator 600 for the predetermined number of times, the controller 100 causes the dimmer 1 to enter the configuration mode and the user releases the sole intensity actuator 600. In some cases, in order to indicate that the dimmer 1 has entered into the configuration mode for adjusting the high-end trim value, the controller 100 may cause the load 5 to be ramped down to the default minimum light intensity value, ramped up to the maximum light intensity value. In some cases, during such indication of the dimmer 1 entering the configuration mode, the user may wait and not adjust the light intensity level. Subsequently, the user selects a new high-end trim value by actuating the sole intensity actuator 600 between 0% and 100% light intensity position. The new high-end trim value may be between the default maximum intensity value and the predetermined high-end trim value (typically 40% light intensity level) or any high-end light intensity value as desired by the user. Next, the new high-end trim value is saved in the memory if the sole intensity actuator 600 has stopped moving for the second predefined period (e.g., five seconds) after the user has selected the new high-end trim value. The first and second predefined periods may be the same or different. In order to indicate that the dimmer 1 has exited the configuration mode, the load 5 may be ramped up to the default maximum intensity value (100%) and then down to the default minimum intensity value (0%), and then back up to the default maximum intensity value, and then finally to the new high-end trim value. In some cases, exiting of the configuration mode may be indicated by the load 5 being ramped up to the default maximum light intensity value, then to the default minimum light intensity value, and then to the new high-end trim value. These sequences are for illustrative purposes only, and thus may change at the user's preference or needs. In some cases, during such indication of the dimmer 1 exiting the configuration mode, the user may wait and not control the light intensity by actuating the sole intensity actuator 600.

Sole intensity potentiometer 700 is mechanically coupled to the controller 100 and the sole intensity actuator 600 and comprising a variable resistor, the sole intensity potentiometer 700 structured to measure an input voltage based on variable resistance, wherein the variable resistance changes based on a position of the sole intensity actuator corresponsive to the first user input, the second user input, or the third user input. The variable resistor is connected in series with a regular resistor and is coupled to a wiper (e.g., a sliding contact), which is in turn mechanically coupled to the sole intensity actuator 600. The variable resistance changes in accordance with the position of the sole intensity actuator 600 and the sole intensity potentiometer 700 itself. As the user actuates the sole intensity actuator 600, the sole intensity potentiometer 700 coupled to the sole intensity actuator 600 is actuated in unison with the sole intensity actuator 600. The sole intensity potentiometer 700 acts as a voltage divider and measures the voltage at a junction between the variable resistor and the regular resistor. This voltage may be referred to as an input voltage since the input voltage is input to the controller 100 via the controller's ADC pin. As such, the sole intensity potentiometer 700 measures the input voltage indicative of the variable resistance in accordance with the position of the sole intensity actuator 600, and transmits the input voltage signal to the controller 100, which in turn sends a dimming signal to the driver circuit 400 based at least in part on the input voltage.

During the normal operation, the light intensity may be based on the default maximum light intensity, the default minimum light intensity, or a user input indicative of desired light intensity. During the configuration mode, the light intensity may be based at least in part on a new end trim value selected by the user. Controller 100 receives the voltage input indicative of the selected light intensity value or new end trim values from the sole intensity potentiometer 700 via its ADC pin. During the normal operation mode, if the user moves the sole intensity actuator 600 to a position indicative of 90% light intensity level, the sole intensity potentiometer 700 provides the variable resistance and input voltage corresponsive to 90% light intensity level. The controller 100 then receives the input voltage from the potentiometer 700 via its analog to digital converter (ADC) pin and adjusts the light intensity of the load 5 accordingly. For the configuration mode, if the input voltage at the potentiometer 700 is indicative of the default minimum light intensity value after repetitive maximum and minimum light intensity values within the first predefined time, the controller 100 understands that the user is requesting to enter the configuration mode. If the potentiometer 700 inputs voltage indicative of a light intensity after the dimmer 1 enter the configuration mode, the controller 100 understands that the input voltage signal indicates a new end trim value selected by the user during the configuration mode.

The dimmer 1 in accordance with the present disclosure allows the user to adjust an end trim value by using the sole intensity actuator 600 (e.g., the main slider of the dimmer 1) and the potentiometer 700 of the dimmer 1. The sole intensity actuator 600 coupled to the potentiometer 700 is used to enter the configuration mode and control maximum and/or minimum light intensity. The dimmer 1 may enter the configuration mode at power-on as well as during regular operation (e.g., run time). This eliminates the use of an additional secondary potentiometer coupled to an additional secondary intensity actuator (e.g., thumb-wheel potentiometer to control the low-end trimming functionality of dimmers) for additional control, end-trimming and/or entering the configuration mode unlike the conventional dimmers that require the use of secondary actuator coupled to a potentiometer for additional control and end-trimming. The additional secondary potentiometer in conventional dimmers require additional space and the controller to continuously monitor its ADC pin for sensing trim levels and slider input. The dimmer 1, thus, reduces manufacturing cost, frees up design spaces within the dimmer 1, and saves power consumption, by eliminating the secondary potentiometer and secondary actuator. Further, the use of the main slider 600 of the dimmer 1 for entering configuration mode and adjusting end trim values provides the user convenience and ease of use. The dimmer 1 also provides ease of assembly as it only requires one sole intensity actuator coupled to one sole intensity potentiometer. Further, the dimmer 1 in accordance with the present disclosure adds a high end trimming functionality, which was not available for the conventional two-wire dimmers. Providing the additional feature of adjusting the high-end trim value offers users more freedom in energy savings and dimming control at reduced cost compared to existing art with secondary potentiometer for minimum intensity control. Moreover, the dimmer 1 in accordance with the present disclosure allows the low-end and high-end trim values to be adjusted without removing the wall-plate, thereby providing ease of installation or customization of the dimmer 1 and more safety for the user during adjusting the end trim values. In addition, the dimmer 1 gives a visual indication of entering and exiting the configuration mode by controlling the intensity of load light. A visual indication of entering and exiting the configuration mode is easily made by automatic ramping up and down of the light intensity among the default maximum light intensity value, the default minimum light intensity value, and/or the new end trim value. Finally, the dimmer 1 in accordance with the present disclosure saves the new end trim values selected by the user in its memory, thereby eliminating the need for the controller 100 to continuously monitor the end trim value selected by the user and the sole intensity actuator input.

FIG. 2 is a diagram of a dimmer 1 in accordance with an example embodiment of the disclosed concept. The dimmer 1 includes a sole intensity actuator 600 and a toggle button or rocker switch 9 for turning on and off the dimmer 1. In FIG. 2, the sole intensity actuator 600 is shown as a slider, but this is for the illustrative purposes only and the sole intensity actuator 600 may be other type of actuator, such as a thumbwheel, one or more push buttons, etc. For normal operation, the user simply moves (e.g., slides) the sole intensity actuator 600 to reach the light intensity that s/he desires. To enter the configuration mode, the user moves the sole intensity actuator 600 between the maximum light intensity and the minimum light intensity repetitively. In order to reset an end trim value, the user simply moves the sole intensity actuator 600 to a position indicative of the user's desired end trim value. The positions of the maximum intensity and the minimum intensity in relation to the dimmer dimension may be indicated by an indicator on the side of the dimmer.

Figure 3:
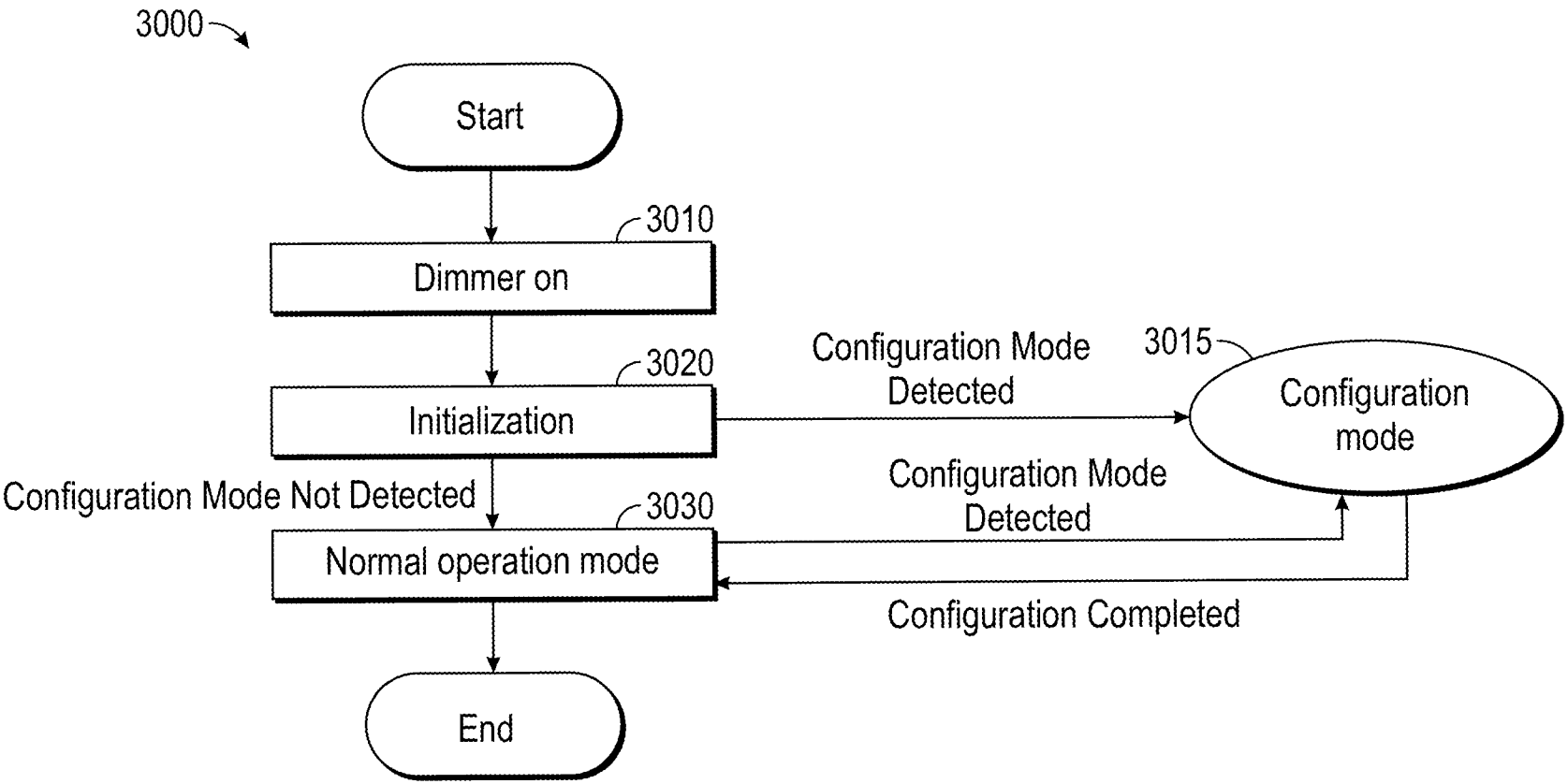
FIG. 3 is a flow chart for a method of adjusting an end trim value in accordance with an example embodiment of the disclosed concept.

FIG. 3 is a flow chart for a method 3000 of adjusting an end trim value in accordance with an example embodiment of the disclosed concept. The method 3000 may be performed by a user, the dimmer 1 or any components therein as described with reference to FIG. 1.

At 3010, the user turns on the dimmer.

At 3020, the dimmer 1 is initialized. The initialization may include the controller of the dimmer determining whether it has detected a user input requesting the dimmer to enter configuration mode. If no such request is detected, the method 3000 continues to 3030. If such request is detected, at 3015, the controller causes the dimmer to enter the configuration mode. Upon completing the configuration for setting a new end trim value by the user, at 3030 the controller causes the dimmer to run normal operation based at least in part on the new end trim value.

At 3030, the controller causes the dimmer to run normal operation. The normal operation may be based at least in part on the new end trim value if the user has selected a new end trim value during the configuration mode. If the user has not requested to enter configuration mode, the normal operation may be based on the default maximum/minimum light intensity values or saved end trim values previously selected by the user. Then, the method 3000 ends (e.g., by the user turning off the dimmer). If, at 3030, the controller detected a request to enter configuration mode, the method returns to 3015 in which the controller causes the dimmer to enter the configuration mode. Upon completing the configuration for setting a new end trim value by the user, at 3030 the controller causes the dimmer to run normal operation based at least in part on the new end trim value, and then the method 3000 ends.

Figure 4:
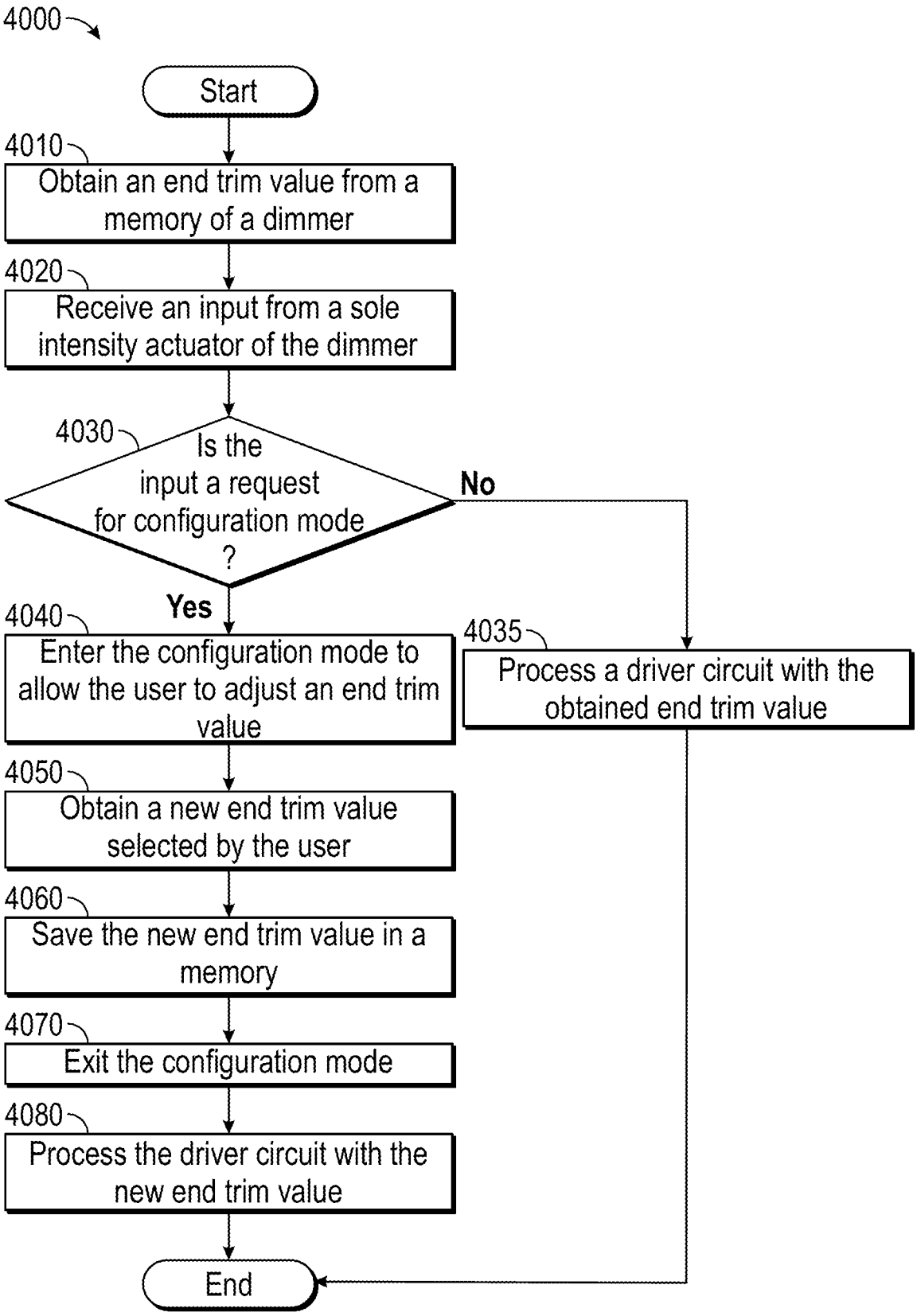
FIG. 4 is a flow chart for a method of adjusting an end trim value in accordance with an example embodiment of the disclosed concept.

FIG. 4 is a flow chart for a method 4000 of adjusting an end trim value in accordance with an example embodiment of the disclosed concept. The method 4000 may be performed by a user, the dimmer 1 or any components therein as described with reference to FIG. 1.

At 4010, the controller obtains an end trim value from a memory of a dimmer. The end trim value may be the default maximum/minimum light intensity set by manufacturer or end trim values previously selected by the user.

At 4020, the controller receives an input from a sole intensity actuator coupled to a sole intensity potentiometer of the dimmer. The sole intensity potentiometer then transmits a voltage input signal to an ADC pin of the controller based at least in part on the sole intensity actuator input.

At 4030, the controller determines whether the sole intensity actuator input is a request for configuration mode. If yes, the method 4000 continues to 4040. If no, at 4035 the controller processes a driver circuit in accordance with the obtained end trim value. The obtained end trim value may be the default maximum light intensity, the default minimum light intensity or end trim values previously selected by the user. The determination whether a request (e.g., a user input) requesting for configuration mode is detected may be made at power-on of the dimmer or during normal operation.

At 4040, the controller causes the dimmer to enter the configuration mode to allow the user to adjust an end trim value. The controller may indicate that the dimmer has entered the configuration mode by ramping up the light intensity of the load between the default maximum and minimum light intensity value.

At 4050, the controller obtains a new end trim value selected by the user. The controller receives the voltage input from the potentiometer via the ADC pin and determines the selected end trim value based on the voltage input.

At 4060, the controller saves the new end trim value in a memory.

At 4070, the controller causes the dimmer to exit the configuration mode. The controller may indicate that the dimmer has exited the configuration mode by ramping up the light intensity of the load among the default maximum light intensity value, the minimum light intensity value, and then to the selected end trim value.

At 4080, the controller processes the driver circuit with the new end trim value. Then, the method 4000 ends.

Figure 5:
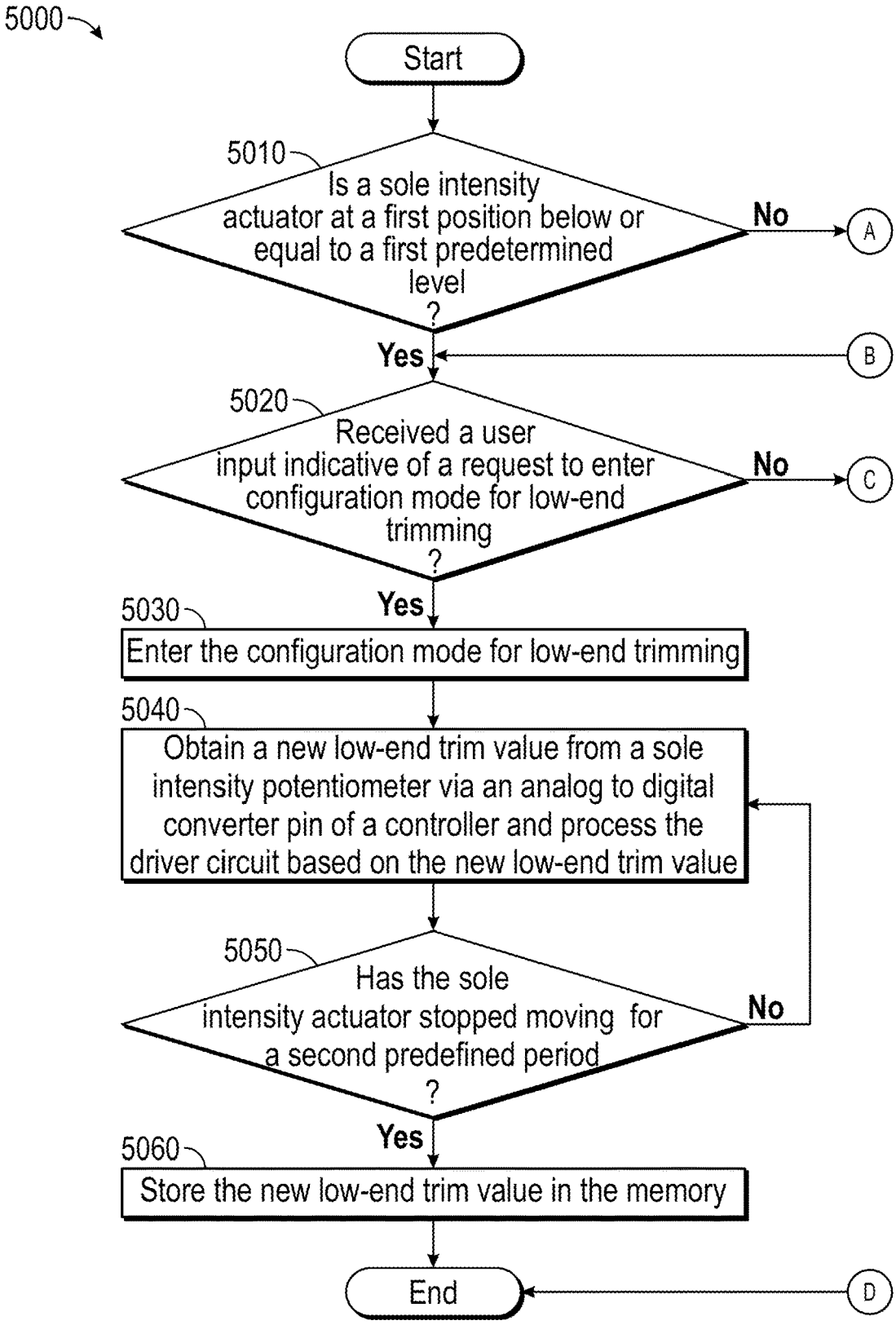
FIG. 5 is a flow chart for a method of adjusting a low-end trim value in accordance with an example embodiment of the disclosed concept.
Figure 5:
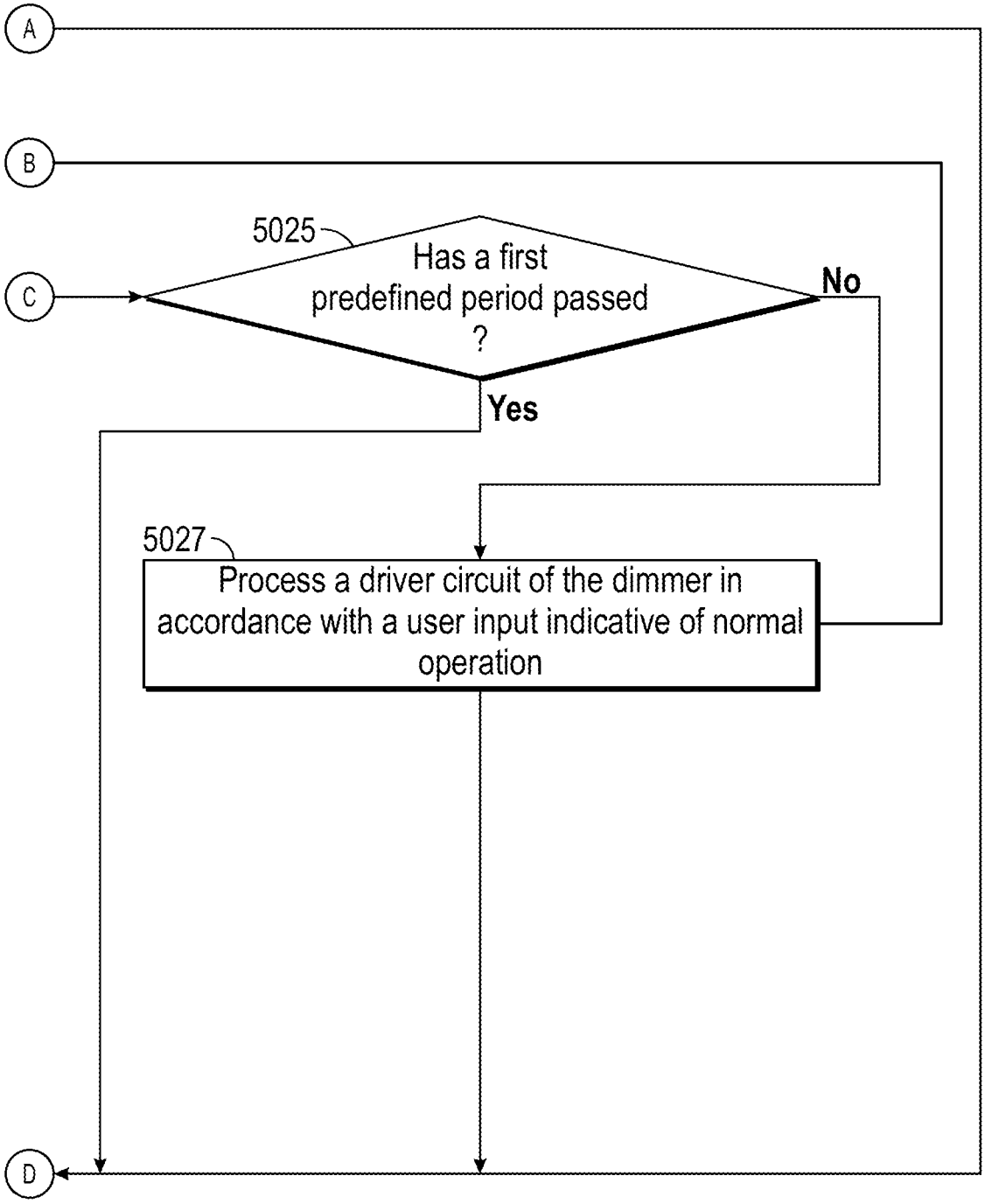

FIG. 5 is a flow chart for a method 5000 of adjusting a low-end trim value in accordance with an example embodiment of the disclosed concept. The method 5000 may be performed by a user, the dimmer 1 or any components therein as described with reference to FIG. 1.

At 5010, the controller determines whether a sole intensity actuator of a dimmer is at a first position below or equal to a first predetermined level. The first predetermined level may be, e.g., without limitation, below 40% of the maximum level, equal to 0% of the maximum level, etc. The sole intensity actuator may be a slider, button, etc. In some cases, this step may be skipped and the method 5000 may commence at step 5020.

At 5020, the controller determines whether it has received a user input indicative of a request to enter configuration mode for low-end trimming. The request may be the first actuation of the sole intensity actuator coupled to the sole intensity potentiometer including actuating the sole intensity actuator to a first position below or equal to a first predetermined level (e.g., without limitation, below 40% of the maximum level, equal to 0% of the maximum level, etc.), then, the user may move the sole intensity actuator to a second position above or equal to a second predetermined level (e.g., without limitation, above 60% of the maximum level, equal to 100% of the maximum level, etc.) and back to below the first predetermined level a predetermined number of times (e.g., without limitation, three times) within a first predefined period (e.g., without limitation, five seconds). If the controller has received the user input indicative of the request for low-end trimming, the method 5000 proceeds to 5030. If the controller has not received the user input indicative of the request for low-end trimming, at 5025 the controller determines whether a first predefined period has passed. The first predefined period may be, e.g., five seconds. If yes, the method 5000 ends. If no, at 5027 the controller processes a driver circuit of the dimmer in accordance with a user input indicative of normal operation. The normal operation may be based on the default maximum/ minimum light intensity or previously selected low-end trim values by the user and the method 5000 ends.

At 5030, the controller causes the dimmer to enter the configuration mode for low-end trimming. The controller may indicate that the dimmer has entered into the configuration for low-end trimming, the indication including changing the light intensity of a load in a first sequence including ramping down the load to the minimum light intensity, ramping up the load to the maximum light intensity, and ramping down the load to the minimum light intensity. During this indication, the user waits and may not control the intensity by moving the slider.

At 5040, the controller obtains a new low-end trim value from a sole intensity potentiometer via an analog to digital converter pin of a controller and processes the driver circuit based on the new low-end trim value. The user selects the new low-end trim value by simply moving the sole intensity actuator to a position indicative of the user's desired low-end trim value. The controller receives the new low-end trim value from the sole intensity potentiometer via its ADC pin.

At 5050, the controller determines whether the sole intensity actuator has stopped moving for a second predefined period. The second predefined period may be, e.g., five seconds. If no, the method 5000 returns to 5040. If yes, the method 5000 continues to 5060. Upon the lapse of the second predefined period, the controller may indicate that the dimmer has exited the configuration mode, where the indication includes changing the light intensity of the load in a second sequence including: ramping down the load to the minimum light intensity. ramping up the load to the maximum light intensity, ramping down the load to the minimum light intensity; and ramping up the load to the new low-end trim value selected by the user.

At 5060, the controller stores the new low-end trim value in the memory. Then, the dimmer operates based at least in part on the new low-end value, and later the method 500 ends.

Figure 6:
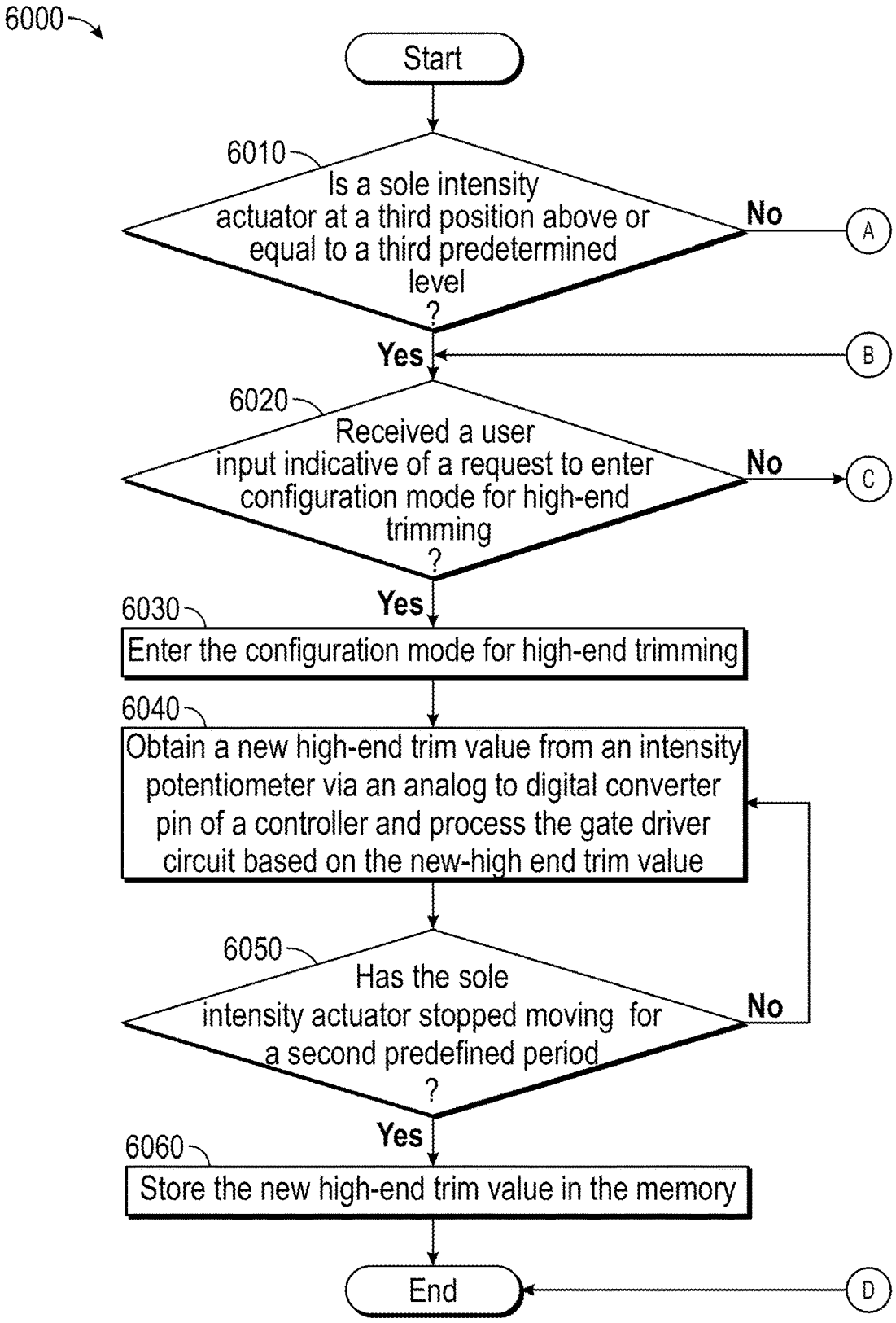
FIG. 6 is a flow chart for a method of adjusting an end trim value in accordance with an example embodiment of the disclosed concept.
Figure 6:
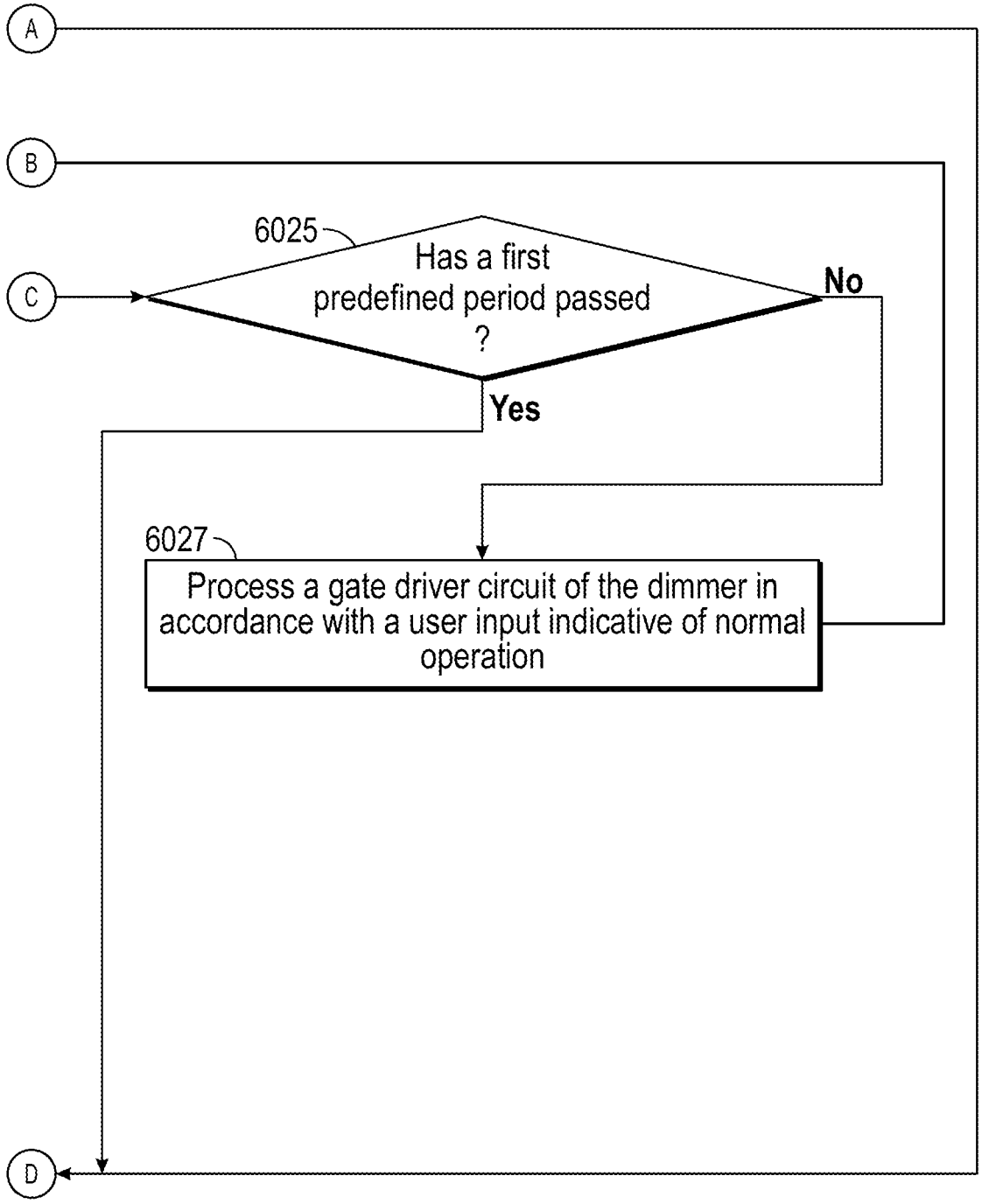

FIG. 6 is a flow chart for a method 6000 of adjusting a high-end trim value in accordance with an example embodiment of the disclosed concept. The method 6000 may be performed by a user, the dimmer 1 or any components therein as described with reference to FIG. 1.

At 6010, the controller determines whether a sole intensity actuator of a dimmer is at a third position above or equal to a third predetermined level (e.g., without limitation, above 60% of the maximum level, equal to 100% of the maximum level, etc.). The sole intensity actuator may be a slider, button, etc. In some cases, this step may be skipped and the method 6000 may commence at step 6020.

At 6020, the controller determines whether it has received a user input indicative of a request to enter configuration mode for high-end trimming. The user input indicative of the request to enter configuration mode for high-end trimming may include actuating the sole intensity actuator of the dimmer. The request may include the first actuation of the sole intensity actuator coupled to the sole intensity potentiometer including actuating the sole intensity actuator to a third position from above or equal to a third predetermined level (e.g., without limitation, above 60% of the maximum level, equal to 100% of the maximum level, etc.) to a fourth position below or equal to a fourth predetermined level (e.g., without limitation, below 40% of the maximum level, equal to 0% of the maximum level, etc.) and back a predetermined number (e.g., three times, four times, etc.) of times within a third predefined time (e.g., five seconds, etc.). If the controller has received the user input indicative of the request for high-end trimming, the method 6000 proceeds to 6030. In some cases, the controller may indicate that the dimmer has entered the configuration mode, where the indication includes changing the light intensity of the load in a third sequence including ramping down the load to the minimum light intensity, and ramping up the load to the maximum light intensity. If the controller has not received the user input indicative of the request for high-end trimming, at 6025 the controller determines whether the third predefined period has passed. The third predefined period may be, e.g., five seconds. If yes, the method 6000 ends. If no, at 6027 the controller processes a driver circuit of the dimmer in accordance with a user input indicative of normal operation. The normal operation may be based on the default maximum light intensity, the default minimum light intensity or previously selected high-end trim values by the user and the method 6000 ends.

At 6030, the controller causes the dimmer to enter the configuration mode for high-end trimming. The controller may indicate that the dimmer has entered the configuration for high-end trimming by ramping down to the default minimum light intensity and then to the default maximum light intensity. During this indication, the user waits and may not control the intensity by moving the sole intensity actuator.

At 6040, the controller obtains a new high-end trim value from a sole intensity potentiometer via an analog to digital converter pin of a controller and processes the driver circuit based on the new high-end trim value. The user selects the new high-end trim value by simply actuating the sole intensity actuator to a position indicative of the user's desired high-end trim value. The controller receives the new high-end trim value from the sole intensity potentiometer via its ADC pin.

At 6050, the controller determines whether the sole intensity actuator has stopped moving for a fourth predefined period. The fourth predefined period may be, e.g., five seconds. If no, the method 6000 returns to 6040. If yes, the method 6000 continues to 6060. Upon the lapse of the second predefined period, the controller may indicate that the dimmer has exited the configuration mode, where the indication comprises changing the light intensity of the load in a fourth sequence including ramping up the load to the maximum light intensity, ramping down the load to the minimum light intensity, ramping up the load to the maximum light intensity, ramping down the load to the new high-end trim value selected by the user, This sequence is for illustrative purposes only, and thus may change at the user's preference or needs. During this indication, the user waits and may not control light intensity by moving the sole intensity actuator.

At 6060, the controller stores the new high-end trim value in the memory. Then, the dimmer operates based at least in part on the new high-end value, and later the method 6000 ends.

Figure 7:
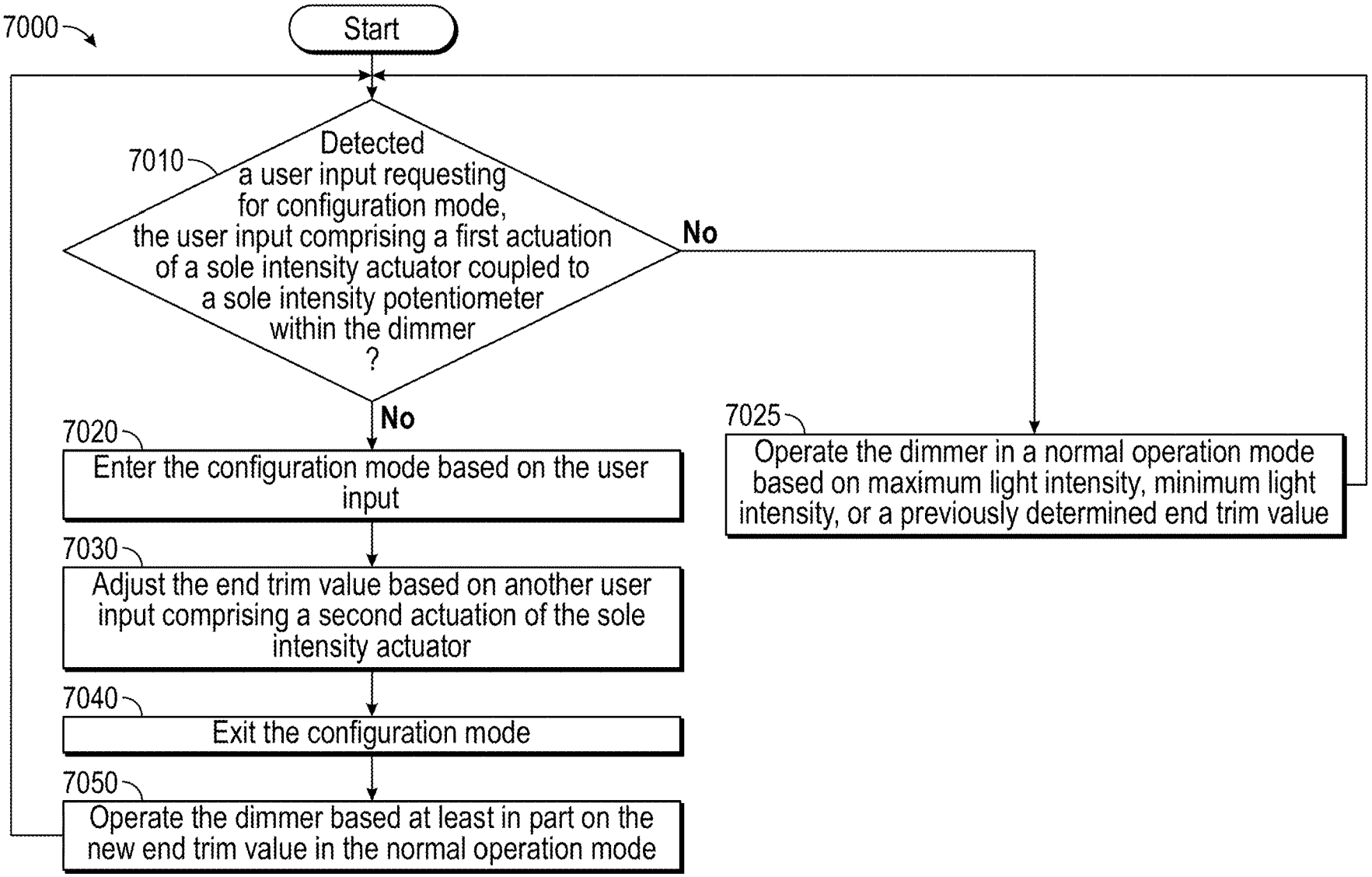
FIG. 7 is a flow chart for a method of adjusting an end trim value in accordance with an example embodiment of the disclosed concept.

FIG. 7 is a flow chart for a method 7000 of adjusting an end trim value in accordance with an example embodiment of the disclosed concept. The method 7000 may be performed by a user, the dimmer 1 or any components therein as described with reference to FIG. 1.

At 7010, the controller determines whether a user input requesting for configuration mode has been detected. If no, at 7025 the controller operates the dimmer in a normal operation mode based on maximum light intensity, minimum light intensity, or a previously determined end trim value, and then the method 7000 returns to 7010. If yes, the method 7000 continues to 7020.

At 7020, the dimmer enters the configuration mode based on the user input.

At 7030, the controller adjusts the end trim value based on another user input comprising a second actuation of the sole intensity actuator.

At 7040, the dimmer exits the configuration mode.

At 7050, the controller operates the dimmer based at least in part on the new end trim value in the normal operation and then the method 7000 returns to 7010.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A dimmer comprising:

a sole intensity actuator structured to be actuated between a maximum light intensity and a minimum light intensity by a user, and is further structured to be used for at least one of:

adjusting light intensity based on a first user input during normal operation; or entering configuration mode based on a second user input; and adjusting an end trim value based on a third user input;

a sole intensity potentiometer mechanically coupled to the sole intensity actuator and comprising a variable resistor, the sole intensity potentiometer structured to measure an input voltage based on variable resistance, wherein the variable resistance changes based on a position of the sole intensity actuator corresponsive to the first user input, the second user input, or the third user input; and a controller coupled to the sole intensity potentiometer and a driver circuit coupled to a bidirectional switching device, the controller structured to control dimmer operation comprising receiving a signal indicative of the measured input voltage from the sole intensity potentiometer and transmitting a dimming signal to the driver circuit for driving the bidirectional switching device, the dimming signal based at least in part on the signal.

2. The dimmer of claim 1, wherein the end trim value comprises a low-end trim value, the second user input comprises actuating the sole intensity actuator to a first position below or equal to a first predetermined level, then to a second position above or equal to a second predetermined level and back to the first position below the first predetermined level a predetermined number of times within a first predefined period, and the third user input comprises actuating the sole intensity actuator to a position indicative of a new low-end trim value selected by the user.

3. The dimmer of claim 2, wherein adjusting the end trim value comprises adjusting the low-end trim value based on the third user input.

4. The dimmer of claim 3, wherein adjusting the low-end trim value comprises:

upon a lapse of second predefined period immediately following the actuation of the second input, storing the new low-end trim value in a memory;

exiting the configuration mode; and operating based at least in part on the new low-end trim value in the normal operation mode.

5. The dimmer of claim 4, wherein exiting the configuration mode comprises a second visual indication comprising changing the light intensity of the load in a second sequence comprising:

ramping down the load to the minimum light intensity;

ramping up the load to the maximum light intensity;

ramping down the load to the minimum light intensity; and ramping up the load to the new low-end trim value selected by the user.

6. The dimmer of claim 2, wherein entering the configuration mode comprises a first visual indication comprising changing the light intensity of the load in a first sequence comprising:

ramping down the load to the minimum light intensity;

ramping up the load to the maximum light intensity; and ramping down the load to the minimum light intensity.

7. The dimmer of claim 1, wherein the end trim value comprises a high-end trim value, the second input comprises actuating the sole intensity actuator from a third position above a third predetermined level to a fourth position below a fourth predetermined level and back to the third position a predetermined number of times within a third predefined time, and the third input comprises moving the sole intensity actuator to a position indicative of a new high-end trim value selected by the user.

8. The dimmer of claim 7, wherein adjusting the end trim value comprises adjusting the high-end trim value based on the third input.

9. The dimmer of claim 8, wherein adjusting the high-end trim value comprises:

upon a lapse of a fourth predefined period following the actuation of the second input, storing the new high-end trim value in memory;

exiting the configuration mode; and operating based at least in part on the new high-end trim value in the normal operation mode.

10. The dimmer of claim 9, wherein exiting the configuration mode comprises a fourth visual indication comprising changing the light intensity of the load in a fourth sequence comprising:

ramping up the load to the maximum light intensity;

ramping down the load to the minimum light intensity;

ramping up the load to the maximum light intensity; and ramping down the load to the new high-end trim value selected by the user.

11. The dimmer of claim 7, wherein entering the configuration mode comprises a third visual indication comprising changing the light intensity of the load in a third sequence comprising:

ramping down the load to the minimum light intensity; and ramping up the load to the maximum light intensity.

12. The dimmer of claim 1, wherein the end trim value comprises a low-end trim value and a high-end trim value.

13. The dimmer of claim 12, wherein adjusting the end trim value comprises at least one of the low-end trim value or the high-end trim value.

14. The dimmer of claim 1, wherein the controller is further structured to store a new end trim value in a memory such that the controller controls the dimmer operation without continuously monitoring an analog to digital converter pin for sensing the first user input, the second user input, or the third user input.

15. The dimmer of claim 1, wherein the first user input comprises actuating the sole intensity actuator based on the maximum light intensity, the minimum light intensity, or a predetermined end trim value.

16. A dimmer system comprising:

a load;

a hot conductor electrically coupled to a power source;

a load conductor electrically coupled to the load; and a dimmer electrically coupled to the hot conductor and the load conductor, the dimmer comprising:

a sole intensity actuator structured to be actuated between a maximum light intensity and a minimum light intensity by a user, and is further structured to be used for at least one of:

adjusting light intensity based on a first user input during normal operation; or entering configuration mode based on a second user input; and adjusting an end trim value based on a third user input;

a sole intensity potentiometer mechanically coupled to the sole intensity actuator and comprising a variable resistor, the sole intensity potentiometer structured to measure an input voltage based on variable resistance, wherein the variable resistance changes based on a position of the sole intensity actuator corresponsive to the first user input, the second user input, or the third user input; and a controller coupled to the sole intensity potentiometer and a driver circuit coupled to a bidirectional switching device, the controller structured to control dimmer operation, comprising receiving a signal indicative of the measured input voltage from the sole intensity potentiometer and transmitting a dimming signal to the driver circuit for driving the bidirectional switching device, the dimming signal based at least in part on the signal.

17. A method for adjusting an end trim value of a dimmer, comprising determining whether a user input requesting for configuration mode is detected, the user input comprising a first actuation of a sole intensity actuator coupled to a sole intensity potentiometer within the dimmer;

based on a determination that the user input is detected, entering the configuration mode, adjusting the end trim value based on another user input comprising a second actuation of the sole intensity actuator, exiting the configuration mode; and operating the dimmer based at least in part on the new end trim value in a normal operation mode; or based on a determination that the user input requesting for the configuration mode is not detected, operating the dimmer in the normal operation mode based on maximum light intensity, minimum light intensity, or a previously determined end trim value.

18. The method of claim 17, wherein the end trim value comprises a low-end trim value, and the first actuation of the sole intensity actuator coupled to the sole intensity potentiometer comprises:

actuating the sole intensity actuator between a first position below or equal to a position indicative of maximum light intensity and a second position above or equal to a position indicative of minimum light intensity for a predetermined number within a first predefined time;

indicating that the dimmer has entered the configuration mode, wherein the indication comprises changing the light intensity of a load in a first sequence comprising:

a. ramping down the load to the minimum light intensity;

b. ramping up the load to the maximum light intensity; and c. ramping down the load to the minimum light intensity.

19. The method of claim 17, wherein the second actuation of the sole intensity actuator coupled to the sole intensity potentiometer comprises:

actuating the sole intensity actuator to a position indicative of a new low-end trim value selected by the user; and indicating that the dimmer has exited the configuration mode, wherein the indication comprises changing the light intensity of the load in a second sequence comprising:

a. ramping down the load to the minimum light intensity;

b. ramping up the load to the maximum light intensity;

c. ramping down the load to the minimum light intensity; and d. ramping up the load to the new low-end trim value selected by the user; and storing the new low-end trim value in a memory.

20. The method of claim 17, wherein the end trim value comprises a high-end trim value, and the first actuation of the sole intensity actuator coupled to the sole intensity potentiometer comprises:

actuating the sole intensity actuator between a second position above or equal to a position indicative of the minimum light intensity and a first position below or equal to a position indicative of the maximum light intensity for a predetermined number within a first predefined time; and indicating that the dimmer has entered the configuration mode, wherein the indication comprises changing the light intensity of the load in a third sequence comprising:

a. ramping down the load to the minimum light intensity; and b. ramping up the load to the maximum light intensity.

21. The method of claim 20, wherein the second actuation of the sole intensity actuator coupled to the sole intensity potentiometer comprises:

actuating the one intensity actuator to a position indicative of a new high-end trim value selected by the user;

indicating that the dimmer has exited the configuration mode, wherein the indication comprises changing the light intensity of the load in a fourth sequence comprising:

a. ramping up the load to the maximum light intensity;

b. ramping down the load to the minimum light intensity;

c. ramping up the load to the maximum light intensity; and d. ramping down the load to the new high-end trim value selected by the user; and storing the new high-end trim value in a memory.

22. The method of claim 20, wherein the end trim value comprises a low-end trim value and a high-end trim value.

23. The method of claim 17, wherein the determination whether a user input requesting for configuration mode is detected is made at power-on of the dimmer or during normal operation.

* * * * *